United States Patent [19]

Kaufman et al.

[11] Patent Number: 4,508,541

[45] Date of Patent: Apr. 2, 1985

[54] MANNICH REACTION PRODUCT AND A MOTOR FUEL COMPOSITION CONTAINING SAME

[75] Inventors: Benjamin J. Kaufman, Wappingers Falls; Rodney L. Sung, Fishkill, both of N.Y.

[73] Assignee: Texaco Inc., White Plains, N.Y.

[21] Appl. No.: 510,487

[22] Filed: Jul. 5, 1983

[51] Int. Cl.[3] ..... C10L 1/22

[52] U.S. Cl. ..... 44/71; 44/75; 562/442; 562/444; 252/403

[58] Field of Search ..... 44/75, 71; 562/444, 562/442; 252/403

[56] References Cited

U.S. PATENT DOCUMENTS

| | | | |
|---|---|---|---|
| 2,908,558 | 10/1959 | Brimer | 44/75 |
| 3,116,129 | 12/1963 | Udelhofen | 44/75 |
| 4,038,043 | 7/1977 | Garth | 44/75 |
| 4,083,699 | 4/1978 | Chibnik | 44/75 |
| 4,231,759 | 11/1980 | Udelhofen et al. | 44/75 |

*Primary Examiner*—Y. Harris-Smith

*Attorney, Agent, or Firm*—Robert A. Kulason; James F. Young; James J. O'Loughlin

[57] ABSTRACT

A material having a use as a detergent in a motor fuel composition is the reaction product of an aldehyde, a phenoxy acid, and a mono- or diamine, wherein the aldehyde includes a hydrocarbon radical having from 1 to about 10 carbon atoms and the phenoxy acid has the following formula:

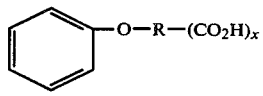

wherein R is any hydrocarbon radical or oxygen-containing hydrocarbon radical of from 1 to about 36 carbon atoms with the carbon atom adjacent to the carboxylic acid functional group having at least one active hydrogen atom, and x varies from about 1 to 3. The monoamine useful in forming the reaction product has the formula:

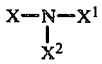

wherein X, $X^1$ and $X^2$ can be any hydrocarbon radical having from about 6 to about 36 carbon atoms, and wherein $X^1$ and $X^2$ can be a hydrogen atom. The diamine has the formula:

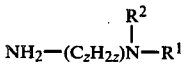

wherein z varies from about 1 to 3, $R^1$ is any hydrocarbon radical or oxygen substituted hydrocarbon radical having from about 6 to 36 carbon atoms and $R^2$ is a hydrogen or a methyl group.

20 Claims, No Drawings

MANNICH REACTION PRODUCT AND A MOTOR FUEL COMPOSITION CONTAINING SAME

BACKGROUND OF THE INVENTION

This invention relates to a reaction product and a motor fuel composition containing the same, and more particularly, to the reaction product of a phenoxy acid, an aldehyde and a mono or diamine, and to a motor fuel composition containing the same.

In order to reduce various undersirable emissions, internal combustion engines have been redesigned. One newly added design feature is the feeding of blow-by gases from the crankcase of the engine into the intake of the air fuel mixture at the carburetor below the throttle plate instead of venting these gases to the atmosphere as was previously done. The blow-by gases contain various substances which can form deposits in and around the throttle plate area of the carburetor. Other deposit forming materials are present in exhaust gases. In newly designed engines, a part of the exhaust gases are recirculated to the fuel air intake of the engines. The deposits formed by the various materials from the recirculated exhaust gases and blow-by gases can restrict the flow of air through the carburetors, especially at idle and low speeds, resulting in an over rich fuel mixture. Such an over rich fuel mixture can produce rough engine idling and stalling which in turn leads to the release of excessive hydrocarbon emissions to the atmosphere. It would thus be desirable to add a material to the gasoline to reduce or eliminate these deposits and prevent their formation.

In U.S. Pat. No. 4,231,759, the reaction product obtained from the Mannich condensation of high molecular weight alkyl-substituted hydroxy aromatic compounds, amines and aldehydes provide an improved detergency in liquid hydrocarbon fuels. Similarly, in U.S. Pat. No. 4,083,699, the detergency properties of a fuel or lubricant are improved by adding thereto a Mannich base product prepared by reacting a high molecular weight alkyl substituted hydroxyaromatic compound, a polyoxyethylene polyamine and an aldehyde.

In U.S. Pat. No. 4,038,043, a combination of monamine and polyamine Mannich condensation products are added to gasoline as a carburetor detergent. The reaction product comprises an alkyl and hydroxy substituted benzyl group condensed with a mono or polyamine.

U.S. Pat. No. 3,116,129 sets forth a corrosion and/or rust inhibitor for petroleum fuel oils which includes a reaction product of an aromatic carboxylic acid and various amines.

U.S. Pat. No. 2,908,558 sets forth the use of N-monoalkyl-p-aminophenol and a N,N'dialkyl-p-aminophenol as inhibiting gum formation in motor fuels.

SUMMARY OF THE INVENTION

It has now been discovered that a reaction product of an aldehyde, a phenoxy acid and a mono- or diamine has a utility as a detergent additive in a motor fuel composition. The aldehyde preferably comprises a hydrocarbon radical containing from 1 to about 10 carbon atoms. The phenoxy acid preferably has the following formula:

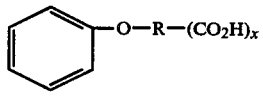

wherein R is any hydrocarbon radical or oxygen-containing hydrocarbon radical of from 1 to about 36 carbon atoms with the carbon atom adjacent to the carboxylic acid functional group having at least one active hydrogen atom, and x varies from about 1 to 3. A monoamine useful in the formation of the reaction product has the formula:

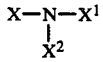

wherein X, $X^1$, $X^2$ can be any hydrocarbon radical having from about 6 to about 36 carbon atoms, and wherein $X^1$ and $X^2$ can be a hydrogen atom. A diamine useful for the formation of the reaction product has the formula:

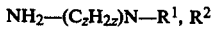

wherein z varies from about 1 to $3R^1$ is any hydrocarbon radical or oxygen substituted hydrocarbon radical having from about 6 to about 36 carbon atoms and $R^2$ is hydrogen or a methyl group.

PREFERRED EMBODIMENTS OF THE INVENTION

A preferred embodiment of the present invention comprises a reaction product of a phenoxy acid, an aldehyde and a mono- or diamine wherein the phenoxy acid has the formula as follows:

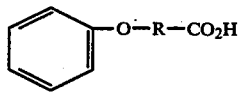

wherein R is a hydrocarbon or oxygen containing hydrocarbon radical having from 1 to about 36, preferably 1 to about 15 carbon atoms and wherein the carbon atom adjacent to the carboxylic acid functional group has at least one active hydrogen. The most preferred phenoxy acid is phenoxyacetic acid (R is equal to $CH_2$). Other preferred phenoxy acids include phenoxypropionic acid, phenoxyacrylic acid, phenoxy-hydroxypropionic acid, phenoxyacetoacetic acid, phenoxy-butanonic acid, phenoxypentanoic acid and phenoxyhexanoic acid.

Suitable aldehydes for use in the reaction product include aliphatic aldehydes such as formaldehyde, acetaldehyde, and aldol. Aromatic aldehydes and aldehydes substituted with oxygen containing groups are also useful. The most preferred aldehyde presently is paraformaldehyde $(CH_2O)_n$.

Presently preferred diamines are N-primary alkylalkylenediamines having the formula:

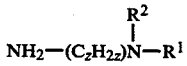

wherein $R^2$ is hydrogen or a methyl group and $R^1$ is a primary aliphatic hydrocarbon radical having from about 6 to 36, preferably 10 to about 30, most preferably 15 to 20 carbon atoms and wherein z can vary from 1 to 3. In the most preferred diamine, z is 3, $R^2$ is a hydrogen atom. Examples of suitable N-alkyl-alkylene diamines include:

N-coco-1,3-diaminopropane,
N-soya-1,3-diaminopropane,
N-tallow-1,3-diaminopropane,
N-oleyl-1,3-diaminopropane,
N-tridecoxypropyl-1,3-diaminopropane,
N-dodecoxypropyl-1,3-diaminopropane,
N-tetradecoxypropyl-1,3-diaminopropane,
N-pentadecoxypropyl-1,3-diaminopropane,
N-octadecoxypropyl-1,3-diaminopropane,
and N-monodecoxypropyl-1,3-diaminopropane.

Also useful as amines are monoamines having the general formula:

$$N{-}X,X^1,X^2$$

wherein X, $X^1$ and $X^2$ can be hydrocarbon radicals or oxygen-containing hydrocarbon radicals preferably aliphatic hydrocarbon radicals having from 1 to about 36, preferably 10 to 30 carbon atoms and wherein X, $X^1$ and $X^2$ can be hydrogen atoms. Presently preferred monoamines comprise the formula:

$$CH_3(\overset{\overset{\displaystyle NH_2}{|}}{C}{}_yH_{2y-1})-CH_3$$

wherein y can vary from about 1 to about 34 and preferably from about 8 to 28 and most preferably from about 13 to 18.

Examples of preferred monoamines include:

| | | |
|---|---|---|
| hydrogenated tallow amine, | | |
| oleylamine | tridecylamine | nonadecylamine |
| cocoamine | tetradecylamine | arachidylamine |
| stearylamine | pentadecylamine | heneicosanylamine |
| laurylamine | hexadecylamine | behenylamine |
| | heptadecylamine | |

The reaction of the phenoxy acid, aldehyde and amine can be carried out in the absence of a solvent, but the use of a solvent is preferred. The most preferred solvent is one which will distill with water azeotropically. Suitable solvents include hydrocarbons boiling in the gasoline boiling range of about 30° C. to about 200° C. and also include saturated and unsaturated hydrocarbons having from about 5 to about 10 carbon atoms. Preferred hydrocarbons include hexane, cyclohexane, benzene, toluene, and mixtures thereof. The most preferred is xylene. The solvent, if used, can be present in an amount up to about 90 percent by weight of the total reaction mixture. Some or all of the solvent can remain in combination with the reaction product to facilitate its addition to gasoline or other mixtures. The reaction product can of course be separated from the solvent by conventional methods.

In one method of the formation of the reaction product, the aldehyde, phenoxy acid and amine are combined with a solvent and heated at a temperature between about 80° and 200° C., most preferably at the reflux temperature of the mixture. The mixture is maintained at this reaction temperature until sufficient water of condensation has been evolved and removed, generally as an azeotrope. The reaction products can then be separated or, as stated above, left in admixture with some or all of the solvent.

It has been found that when the reaction product as set forth above is added to a motor fuel composition, the detergency of the motor fuel composition in relationship to build up of deposits within the carburetor is reduced as compared to motor fuel compositions without such an additive. Preferred motor fuel compositions are those intended for use in spark ignition internal combustion engines. Such motor fuel compositions, generally referred to as gasoline base stocks, preferably comprise a mixture of hydrocarbons boiling in the gasoline boiling range preferably from about 10° C. to about 220° C. This base fuel may consist of straight chain or branched chain paraffins, cycloparaffins, olefins, aromatic hydrocarbons or mixtures of these. The base fuel can be derived, from among others, from straight run naphtha, polymer gasoline, natural gasoline or from catalytically cracked or thermally cracked hydrocarbons and catalytically reformed stocks.

In addition, the motor fuel composition may contain any of the additives generally employed in gasoline. Thus, the fuel composition can contain an antiknock compound such as tetraalkylene lead compound, anti-icing additives, dyes, upper cylinder lubricating oils, and the like.

The reaction product can be added to the gasoline base stock as an additive concentrate. The major component of such a concentrate would be the reaction product of the present invention, minor components would be additives as set forth in the preceeding paragraphs. A suitable solvent, such as a hydrocarbon boiling in the gasoline boiling range can also be included as a minor component of the additive concentrate.

The quantity of reaction product added to the gasoline can vary from about 0.01 to about 0.5 gram per liter of motor fuel composition. Preferably, the quantity of reaction product added will be from about 0.03 to about 0.1 gram per liter of motor fuel composition.

It has also been found that the addition of the reaction product of the present invention to a gasoline base stock not only imparts a detergency to the gasoline but such an additive does not increase the haze of the motor fuel composition. It is preferred that motor fuel compositions do not become cloudy or hazy during storage and use. Many compounds having detergent properties when added to the motor fuel composition cause it to develop a haze because of the retention of water within the motor fuel composition by the additive. It has been found that the reaction product of the present invention when used in effective quantities does not produce an undesirable haze in the motor fuel composition.

The reaction product of the phenoxy acid, aldehyde and amine is believed to proceed by way of one or both of two mechanisms, however, such mechanisms are only given as possible mechanisms and it is to be remembered that the present invention resides in the reaction product and a motor fuel composition containing such reaction product. A postulated mechanism would have the amine add either to the ortho position of the benzene ring of the phenoxy acid or to the methyl carbon directly adjacent to the carboxylic acid functional group. If a mono amine is used, with paraformaldehyde, it is believed that the reaction product of the present invention is either one or a mixture of the following two compounds formed by the following reaction:

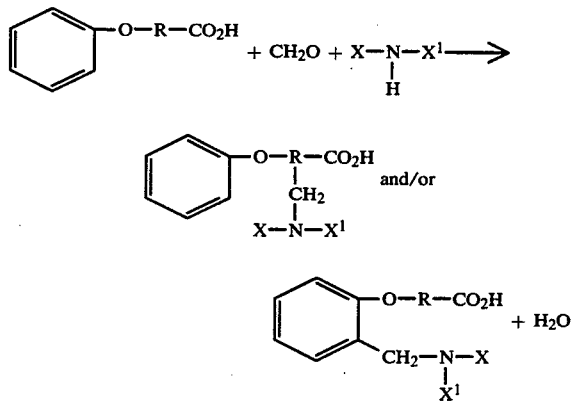

wherein the values for R, X and $X^1$ are as set forth above and $X^2$ is hydrogen.

If a diamine is used with phenoxy acid and paraformaldehyde, it is believed that the reaction product is either one or a mixture of the following two compounds formed by the following postulated mechanism:

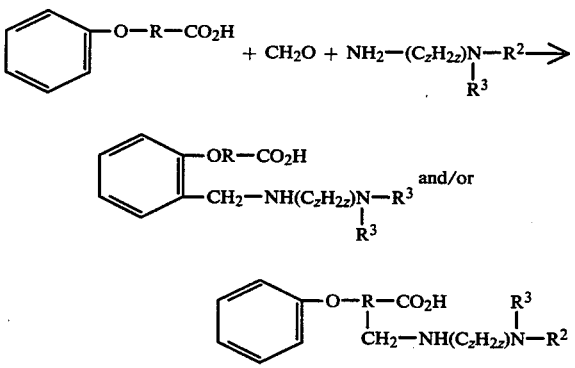

wherein R, $R^1$ $R^2$ and X have the values given above. The reaction product may also contain other compounds, and may in fact be predominantly other compounds.

The present invention will be better understood from the following examples which are only illustrative and not meant to limit the invention in any way.

EXAMPLE I

A reaction product was prepared by adding 38 grams of phenoxyacetic acid, 91 grams of N-oleyl-1,3-propane diamine (Duomeen-O), 11.25 grams of paraformaldehyde and 100 grams of xylene to a reactor. The mixture was refluxed at 149° C. until 6.6 milliliters of water was azeotroped over. The solvent was stripped and 135 grams of product was collected. The molecular weight of the product was determined to be 576, the percent by weight of nitrogen was determined to be 5.1, the total base number was determined to be 137.7 and the saponification number was determined to be 33. The reaction product was then added to a motor fuel composition formulated for spark ignition engines which was similar to a commercially sold unleaded fuel, but did not contain the detergent generally used in the fuel. The reaction product was added at the rate of about 20 pounds (9 kilograms) of additive per 1,000 barrels (159,600 liters) of fuel.

This motor fuel composition was compared to a similar commercial fuel composition containing a commercially used detergent additive in the Chevrolet Carburetor Detergency Test Phase III. In this test, a gasoline fuel composition containing the additive is tested for its ability to remove preformed deposits from the throttle plate area in a carburetor. This test is run on a Chevrolet V-8 engine mounted on a test stand using a modified four-barrel carburetor. The two secondary barrels on the carburetor are sealed. The feed to each of the primary barrels is arranged so that the detergent additive fuel can run in one barrel and a reference fuel or a base fuel run in the other. The primary carburetor barrel was also modified to contain removable aluminum inserts in the throttle plate area so that the deposits formed on the insert could be conveniently weighed.

The engine is run for a period of time, usually 24 or 48 hours, using the base fuel as the feed to both barrels with the engine blow-by circulated to the air inlet of the carburetor to cause a deposits build-up. The weight of the deposits on both sleeves is determined and recorded. The engine is then cycled for 24 additional hours with the reference fuel or base fuel being fed to one barrel and the additive fuel to the other. During this cycle, engine blow-by is circulated to the air inlet of the carburetor. The inserts are then removed from the carburetor and weighed to determine the difference between the performances of the additive-containing fuel of the invention and the reference fuel or base fuel for removing preformed deposits. After the aluminum inserts have been cleaned, they are replaced in the carburetor and the process repeated with the fuel feed inlet to the carburetor reversed in order to minimize differences in fuel distribution and carburetor construction. The results obtained in the fuel runs are averaged and the effectiveness of the reference fuel and of the additive fuel for removing deposits expressed in percent.

The base fuel employed for demonstrating the detergency effectiveness of the additive composition of the invention was an unleaded grade gasoline having a Research Octane Number of about 92.3, and Motor Octane Number of about 84.5. This gasoline consisted of about 26% aromatic hydrocarbons, 8% olefinic hydrocarbons and 66% parrafinic hydrocarbons and boiled in a range from about 86° F. (30° C.) to about 372° F. (190° C.).

The difference, in average weight percent of deposits removed by the fuel composition containing the reaction product of the present invention and the commercial fuel composition, when both had an equal weight in grams of additive, was +4. Thus, a test comparing the use of an equal weight of the reaction product of the present invention as compared to an equal weight of a commercial detergent showed that the reaction product is superior in preventing the buildup of deposits to the previously used detergent.

In order to evaluate the effect of the addition of the reaction product on a tendency of a motor fuel composition to form an emulsion or haze with acidic and basic water bottoms and to examine the stability of such a haze or emulsion, an aqueous emulsion test was performed on the motor fuel composition used in the above paragraphs. The motor fuel composition of the invention containing 20 pounds (9 kilograms) of the additive per 1,000 barrels (159,600 liters) of fuel was subjected to the Waring Blender Emulsion Test which evaluates the tendency of motor fuel compositions to form an emulsion or haze with various water bottoms and to examine the stability of such haze or emulsion.

In this test, a mixture consisting of 95 percent test gasoline and 5 percent test water was mixed at approximately 13,000 rpm for 10 seconds in an explosion proof Waring blender. The mixture was transferred to a graduated cylinder, allowed to stand four hours, and the appearance of the water layer is observed visually and the haze of the gasoline layer was measured with a haze meter. Measurements may be made, if desired, at other intervals also, e.g. 24 hours. The higher the absolute number reading the greater the haze.

The results at varous pH's are as follows for a 4 hour Haze Reading:

| | Waring Blender Emulsion Test | | |
|---|---|---|---|
| | Pounds to the Barrel | pH 5 | pH 12 |
| Instant Invention | 20 | 25 | 12 |
| "Petrox" | 60 | 19 | 46 |

[1]A commercial additive

The additive is thus comparable to the commercial additive package at a lower dosage.

The test showed that the motor fuel composition having the reaction product of the present invention had good water shedding properties and exhibited haze qualities similar to that of commercially sold motor fuel compositions.

EXAMPLE II

Another reaction product was formed by combining 14.75 grams of paraformaldehyde, 100 grams of hydrogenated tallow amine, 48.57 grams of phenoxyacetic acid and 200 grams of xylene in a flask. The mixture was heated to reflux at about 144° C. and kept there until 8.8 grams of water was removed azeotropically. The solvent was then stripped yielding about 139 grams of product. The product had a total base number of about 42.8, a weight percent of nitrogen of about 1.7, a total acid number of about 50.89 and a saponification number of between about 60.22 and 61.97.

The reaction product as made above is expected to act as successfully as a detergent in the Chevrolet Carburetor Detergency Test Phase III and in the haze test as the reaction product of Example I.

The above examples are for illustrative purposes only, modifications and changes can be made by one skilled in the art without going beyond the scope of the invention as set forth in the following claims.

What is claimed is:

1. A material comprising a reaction product of an aldehyde, a phenoxy acid and a mono- or diamine, wherein said aldehyde comprises a hydrocarbon radical having from 1 to about 10 carbon atoms, said phenoxy acid has the following formula:

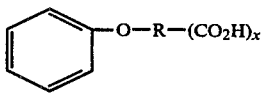

wherein R is any hydrocarbon radical or oxygen-containing hydrocarbon radical of from 1 to about 36 carbon atoms with the carbon atom adjacent to the carboxylic acid functional group having at least one active hydrogen atom, and x varies from 1 to 3, said monoamine has the formula:

$$X-\underset{\underset{X^2}{|}}{N}-X^1$$

wherein X, $X^1$, and $X^2$ can be any hydrocarbon radical having from about 6 to about 36 carbon atoms and wherein $X^1$ and $X^2$ can be a hydrogen atom, said diamine has the following formula:

$$NH_2-(C_zH_{2z})\overset{\overset{R^2}{|}}{N}-R^1$$

wherein z varies from about 1 to 3, $R^1$ is any hydrocarbon radical or oxygen substituted hydrocarbon radical having from about 1 to 36 carbon atoms and $R^2$ is a hydrogen or a methyl group.

2. The material of claim 1 wherein z is equal to 3 and R varies from about 1 to about 15 carbon atoms.

3. The material of claim 1 wherein said aldehyde comprises paraformaldehyde.

4. The material of claim 1 wherein in said diamine $R^1$ comprises a primary aliphatic hydrocarbon radical having from about 15 to 20 carbon atoms, $R^2$ is a hydrogen atom, and z is equal to 3.

5. The material of claim 4 wherein said diamine is selected from the group consisting of:
N-coco-1,3-diaminopropane,
N-soya-1,3-diaminopropane,
N-tallow-1,3-diaminopropane,
N-oleyl-1,3-diaminopropane,
N-tridecoxypropyl-1-,3-diaminopropane,
N-dodecoxypropyl-1,3-diaminopropane,
N-tetradecoxypropyl-1,3-diaminopropane,
N-pentadecoxypropyl-1,3-diaminopropane,
N-octadecoxypropyl-1,3-diaminopropane,
and N-monodecoxypropyl-1,3-diaminopropane.

6. The material of claim 1 wherein in said monoamine X is a hydrocarbon radical having the formula:

$$CH_3(C_yH_{2y-1})-CH_3$$

wherein y can vary from 1 to about 34, and wherein $X^1$ and $X^2$ are both hydrogen atoms.

7. The material of claim 6 wherein said monoamine is selected from the group consisting of:

| | | |
|---|---|---|
| hydrogenated tallow amine, | | |
| oleylamine | tridecylamine | nonadecylamine |
| cocoamine | tetradecylamine | arachidylamine |
| stearylamine | pentadecylamine | heneicosanylamine |
| laurylamine | hexadecylamine | behenylamine |
| | heptadecylamine | |

8. The material of claim 1 wherein said material further comprises a solvent.

9. The material of claim 1 wherein said aldehyde comprises paraformaldehyde, said phenoxy acid comprises phenoxyacetic acid and said diamine comprises N-oleyl-1,3-propane diamine.

10. The material of claim 1 wherein said aldehyde comprises paraformaldehyde, said phenoxy acid comprises phenoxyacetic acid and said monoamine comprises hydrogenated tallow amine.

11. A motor fuel composition comprising a major amount of a mixture of hydrocarbons in the gasoline boiling range and a minor amount of the material of claim 1.

12. A motor fuel composition comprising a major amount of a mixture of hydrocarbons in the gasoline boiling range and a minor amount of the material of claim 9.

13. An additive concentrate comprising a major amount of the material of claim 1 and a minor amount of at least one component selected from the group consisting of an antiknock compound, an anti-icing additive, a dye, an upper cylinder lubricating oil, and a hydrocarbon boiling in the gasoline boiling range.

14. A material comprising a reaction product of paraformaldehyde, phenoxyacetic acid, and a mono or diamine, wherein said mono amine has the formula:

$$NH_2—X$$

wherein X can be a hydrocarbon radical or oxygen-containing hydrocarbon radical having from 1 to about 36 carbon atoms and wherein said diamine has the formula:

$$NH_2—(C_zH_{2z})\underset{\underset{R^2}{|}}{N}—R^1$$

wherein $R^2$ is a hydrogen or a methyl group, $R^1$ is a primary aliphatic hydrocarbon radical having from about 6 to 36 carbon atoms and wherein z is from 1 to 3.

15. The material of claim 14 wherein in the diamine, z has the value of 3, $R^2$ is a hydrogen atom and $R^1$ is a primary aliphatic hydrocarbon radical having from about 10 to about 30 carbon atoms.

16. The material of claim 14 wherein in said monoamine, X is an aliphatic hydrocarbon radical having from about 10 to 30 carbon atoms.

17. The material of claim 14 wherein said monoamine has the formula:

$$CH_3(\overset{\overset{NH_2}{|}}{C_yH_{2y-1}})—CH_3$$

and wherein y varies from about 10 to 28.

18. A motor fuel composition comprising a major amount of hydrocarbons in the gasoline boiling range and a minor amount of the material of claim 14.

19. A motor fuel composition comprising a major amount of hydrocarbons in the gasoline boiling range and a minor amount of the material of claim 15.

20. An additive concentrate for a motor fuel composition comprising a major amount of the material of claim 14 and a minor amount of at least one component selected from the group consisting of hydrocarbons in the gasoline boiling range, an antiknock compound, an antiicing additive, a dye, and an upper cylinder lubricating oil.

* * * * *